US007914231B2

(12) United States Patent
Coppes et al.

(10) Patent No.: US 7,914,231 B2
(45) Date of Patent: Mar. 29, 2011

(54) LEACHING CHAMBER HAVING A DIAGONALLY RIBBED TOP

(75) Inventors: Bryan A. Coppes, Old Saybrook, CT (US); Douglas Hardesty, East Lyme, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 12/074,335

(22) Filed: Mar. 3, 2008

(65) Prior Publication Data

US 2008/0226394 A1 Sep. 18, 2008

Related U.S. Application Data

(60) Provisional application No. 60/904,486, filed on Mar. 2, 2007.

(51) Int. Cl.
*E02B 13/00* (2006.01)

(52) U.S. Cl. ..... 405/49; 405/46; 405/45; 405/43

(58) Field of Classification Search ..... 405/49, 405/46, 45, 44, 43
See application file for complete search history.

(56) References Cited

U.S. PATENT DOCUMENTS

| | | | | |
|---|---|---|---|---|
| 5,669,733 | A * | 9/1997 | Daly et al. | 405/49 |
| 5,890,838 | A * | 4/1999 | Moore et al. | 405/49 |
| 6,602,023 | B2 * | 8/2003 | Crescenzi et al. | 405/42 |
| 6,698,975 | B1 * | 3/2004 | Benecke | 405/49 |
| 7,160,059 | B2 * | 1/2007 | Hedstrom et al. | 405/49 |

* cited by examiner

*Primary Examiner* — Frederick L Lagman
(74) *Attorney, Agent, or Firm* — Steven M. McHugh; Charles G. Nessler

(57) ABSTRACT

A leaching chamber having opposing inwardly and upwardly running sidewalls extending toward a top portion is provided, wherein the leaching chamber includes a plurality of peak and valley corrugations formed by the sidewalls and extending over the top portion and a plurality of diagonally opposed ribs, the plurality of ribs extending diagonally across at least a portion of the top portion to form at least one X shaped pattern.

17 Claims, 8 Drawing Sheets

LEACHING CHAMBER HAVING A DIAGONALLY RIBBED TOP

RELATED APPLICATIONS

This application claims the benefit of U.S. Provisional Application Ser. No. 60/904,486 filed Mar. 2, 2007 entitled "Leaching Chamber Having a Ribbed Top", the contents of which are incorporated herein by reference in its entirety.

FIELD OF THE INVENTION

This invention relates generally to leaching chambers and more particularly to leaching chambers for treating waste water having improved strength against vertical loads when buried in soil

BACKGROUND OF THE INVENTION

Leaching chambers made from thermoplastic materials are well known in the art and most have a number of design characteristics in common for both functional and manufacturing reasons. Some of these chambers have slotted, inwardly sloped, planar sidewalls which run up to a curved arch top and an arch-shape cross section with wide peak and valley corrugations running up over the arch. Slotted sidewall perforations may be included to provide open area for infiltration of wastewater through the sidewall into the soil surrounding the chamber. However, slots or other perforations weaken the sidewall. This weakened sidewall is undesirable because in use leaching chambers must resist the loads from both overlying soil, and from vehicles and other things traveling along the soil surface, as well as lateral load of soil on the sidewall.

One approach used to strengthen these chambers involves substantially thickening the sidewall in the vicinity of the slots as well as providing other structures for strength. Another approach included adding ribbing on the interior and exterior portions of the chamber. For example, in a commercial injection molded thermoplastic leaching chamber of the type sold by Infiltrator Systems, Inc., (hereinafter "ISI"), of Old Saybrook, Conn., ribbing on the interior and exterior of the chamber was used to strengthen the chamber. U.S. Pat. Nos. 4,759,661 and 5,511,903, both to Nichols et al., show chambers having features like those sold in commerce by Infiltrator Systems. These kind of chambers, a partial vertical cross section of which is shown in FIG. 5, generally have a nominally trapezoidal cross section of the prior art (i.e. planar side walls with a curved top). These chambers also have corrugations (comprised of peaks and valleys) running along the curve of the arch shape cross section and ribs running lengthwise and crosswise in rectangular fashion at various locations and are referred to hereinafter as 'the ISI standard chamber design'. See U.S. Pat. No. 5,716,163 to Nichols et al. for embodiments of ribs in the chambers having ribs.

Compared to the ISI standard chambers, Quick4® chambers, sold in recent years by Infiltrator Systems, have an improved design, namely continuous curve cross sections and truncated semi-ellipse cross sections as exemplified by chambers shown in U.S. Pat. No. 7,118,306 to Kruger et al. and U.S. Pat. No. 7,189,027 (patent application Ser. No. 10/677,938) to Brochu et al. In such chambers, the corrugations are closer together. Compared to the older trapezoidal cross section chamber, the new design enables thinner walls and eliminate the need for ribs. This is because the continuous curve design distributed the load well and avoided the stress concentrations and associated design limitations of some of the older chambers. The absence of ribs provides for better nesting to the chambers. It should be appreciated that all of the foregoing patents/patent applications are owned in common with this application and the disclosures thereof are hereby incorporated by reference.

Continuous arch cross section chambers have been construct with designs which are modified in that, e.g., to make a wider chamber with more storage capacity, a nearly flat (horizontal) portion is designed into the top of the chamber. In these newer chambers, although the rib-free benefits of the continuous curve design are largely maintained, there is some diminution in the torsional stiffness, which stiffness is of some consequence in some applications and in manual handling of chambers. It is also desirable to provide the ISI standard design chamber with similarly improved properties.

SUMMARY OF THE INVENTION

A leaching chamber having opposing inwardly and upwardly running sidewalls extending toward a top portion is provided, wherein the leaching chamber includes a plurality of peak and valley corrugations formed by the sidewalls and extending over the top portion and a plurality of diagonally opposed ribs, the plurality of ribs extending diagonally across at least a portion of the top portion to form at least one X shaped pattern.

An arch shaped cross section chamber, for use in receiving and dispersing wastewater or storm-water within soil, having corrugations comprised of a multiplicity of alternating peaks and valleys which run transversely to the length of the chamber is provided and includes opposing sidewalls running inwardly and upwardly towards a top of the chamber from opposing side base flanges, wherein the top of the chamber connects the upper portions of the opposing sidewalls and a plurality of ribs running across the tops of the valleys, each rib lying in a vertical plane which runs diagonally relative to the vertical lengthwise center plane of the chamber.

A chamber comprised of peak and valley corrugations and having a base, a top portion, and opposing sidewalls running inwardly and upwardly from the base to the top portion is provided and includes a plurality of diagonally opposed ribs located in at least one of the peak and valley corrugations at the top portion of the chamber, the plurality of ribs extending diagonally across at least a portion of the top portion to form at least one X shaped pattern.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION

In accordance with the present invention, diagonal ribs are effective in increasing the torsional stiffness and strength of a chamber, that is, resistance to bending and loads which tend to twist the chamber about its longitudinal axis when torsional moments are applied to the chambers in certain kinds of applications, for example when they are used in mound type leaching fields and the surrounding and overlying soil is machine-compacted. Torsional stiffness is also significant to certain users during handling of chambers during the installation process. The ribs of the present invention also increase the section modulus of the top to improve resistance to both vertical loads and loads transmitted to the top by the sidewalls.

Various prior art chambers had tops comprising an array of mutually orthogonal ribs, referred to herein as a "rectangular pattern"; sometimes the construction has been called an egg-crate pattern. Certain prior art ribbed-strengthened chambers had two essential configurations: First, the ribs projected upwardly from the upper surface of the top at the valley location, that is, between adjacent peaks. Second, the ribs projected downwardly from the lower surface of the top at the peak location, that is, between adjacent valleys. In connection with work on the present invention, measurements were made to compare the torsional stiffness of a first chamber having a rectangular pattern of ribs at the valley tops with a second chamber having a diagonal pattern of ribs at the valley tops, that is, along the lines of the chamber pictured in FIG. 6. The experiments produced a surprising result: the torsional stiffness of the invention chamber was 50 to 100 percent or more greater than the comparable having a rectangular pattern.

Figure 1A:
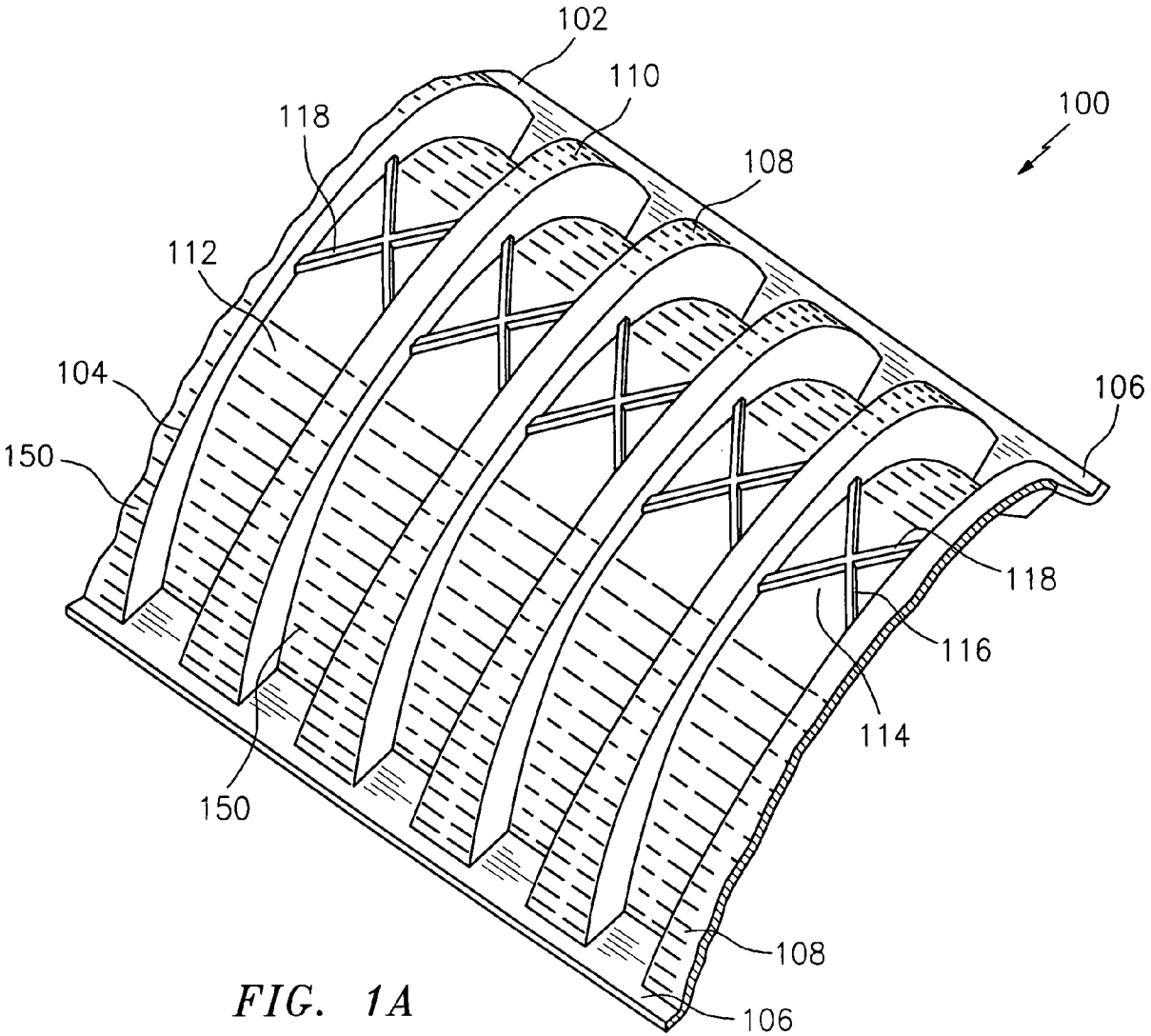
FIG. 1A is an isometric view looking down at a top portion of a ribbed and corrugated leaching chamber having a diagonal ribbed pattern, in accordance with the invention.
Figure 1B:
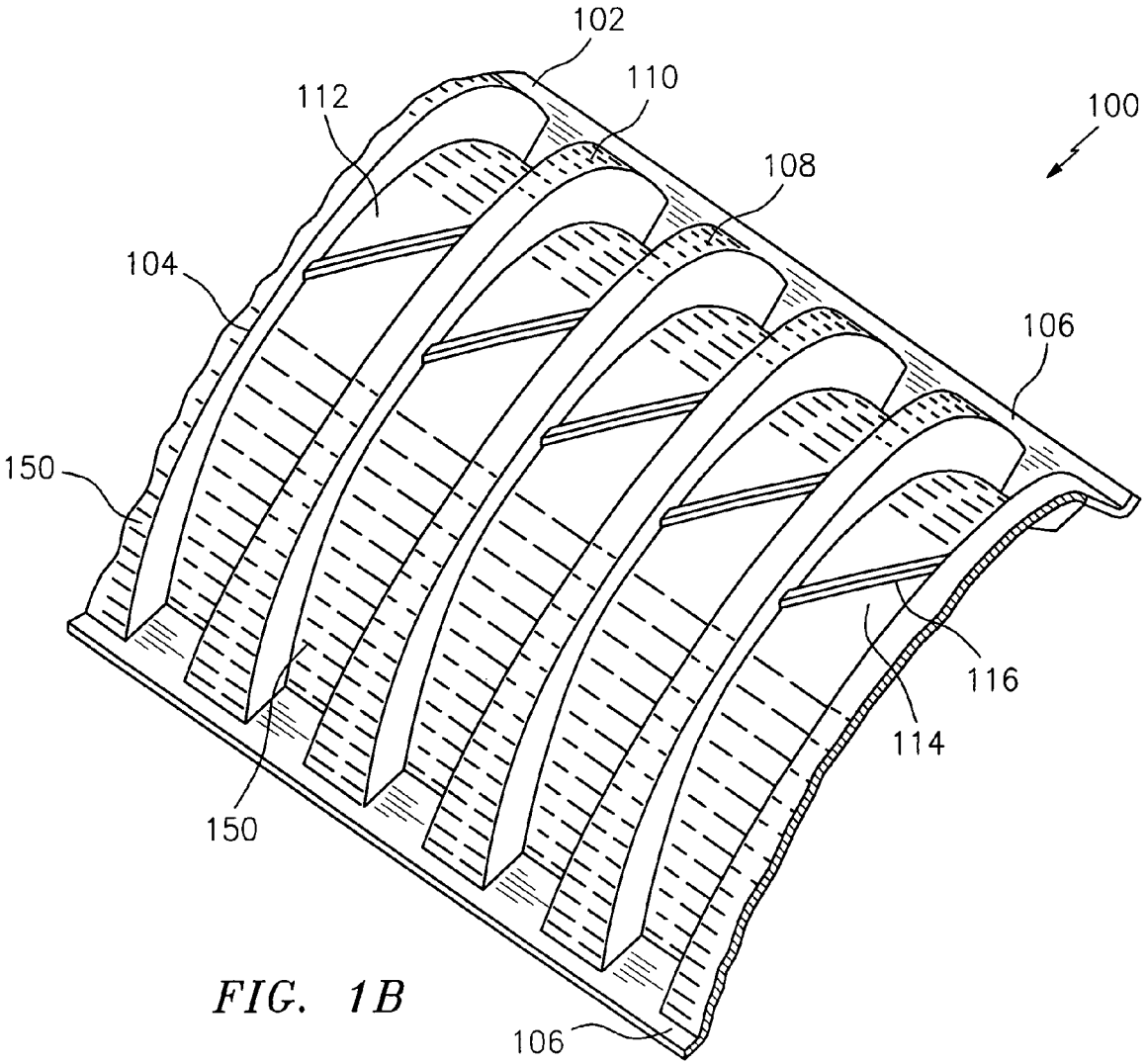
FIG. 1B is an isometric view looking down at the chamber of FIG. 1 having a diagonal ribbed pattern comprising only one rib, in accordance with the invention.
Figure 2:
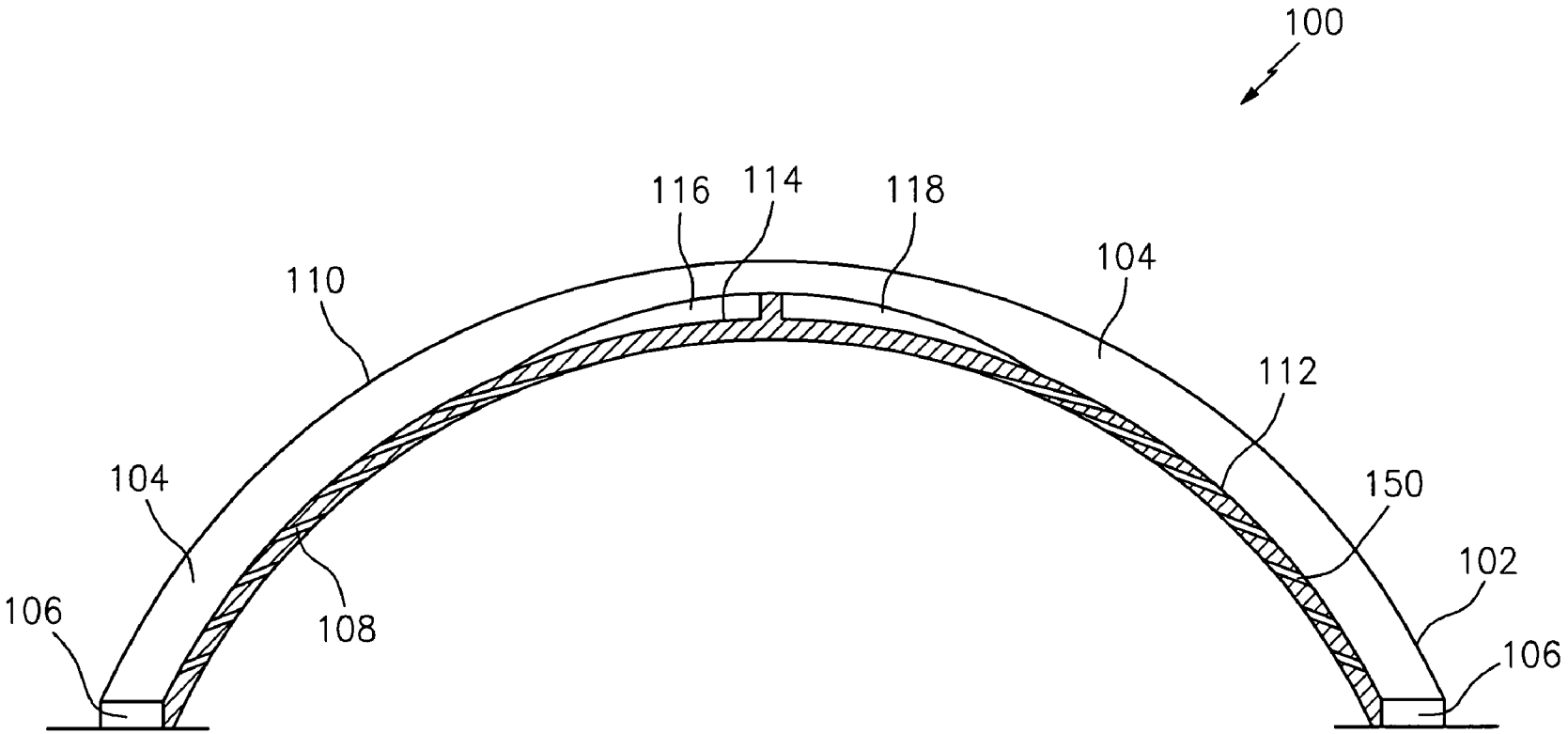
FIG. 2, is a transverse vertical cross section of the leaching chamber of FIG. 1.
Figure 5:
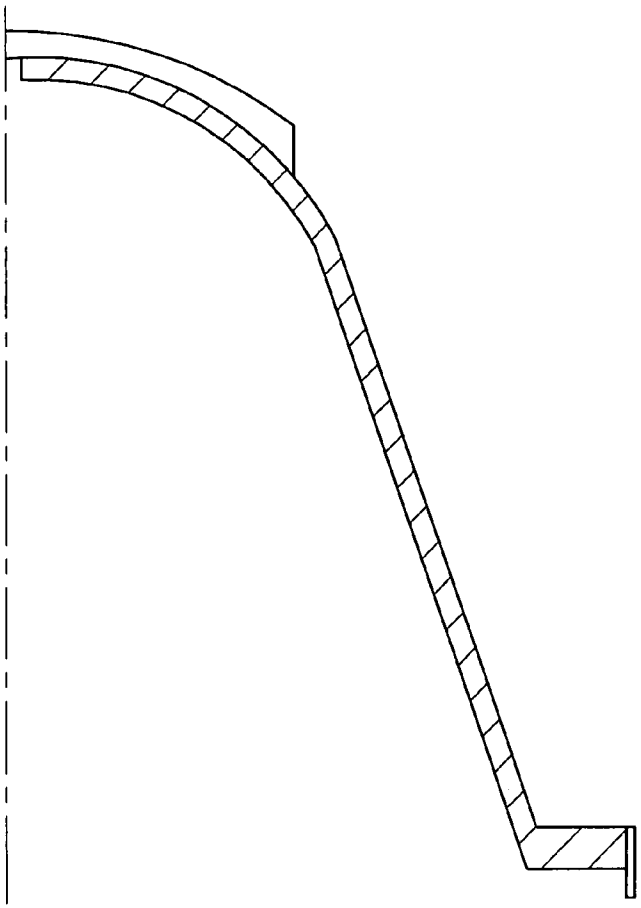
FIG. 5 (PRIOR ART)
FIG. 5 is a half vertical cross section view of the leaching chamber of FIG. 3, illustrating the planar (uncurved) wall and curved top.
Figure 6:
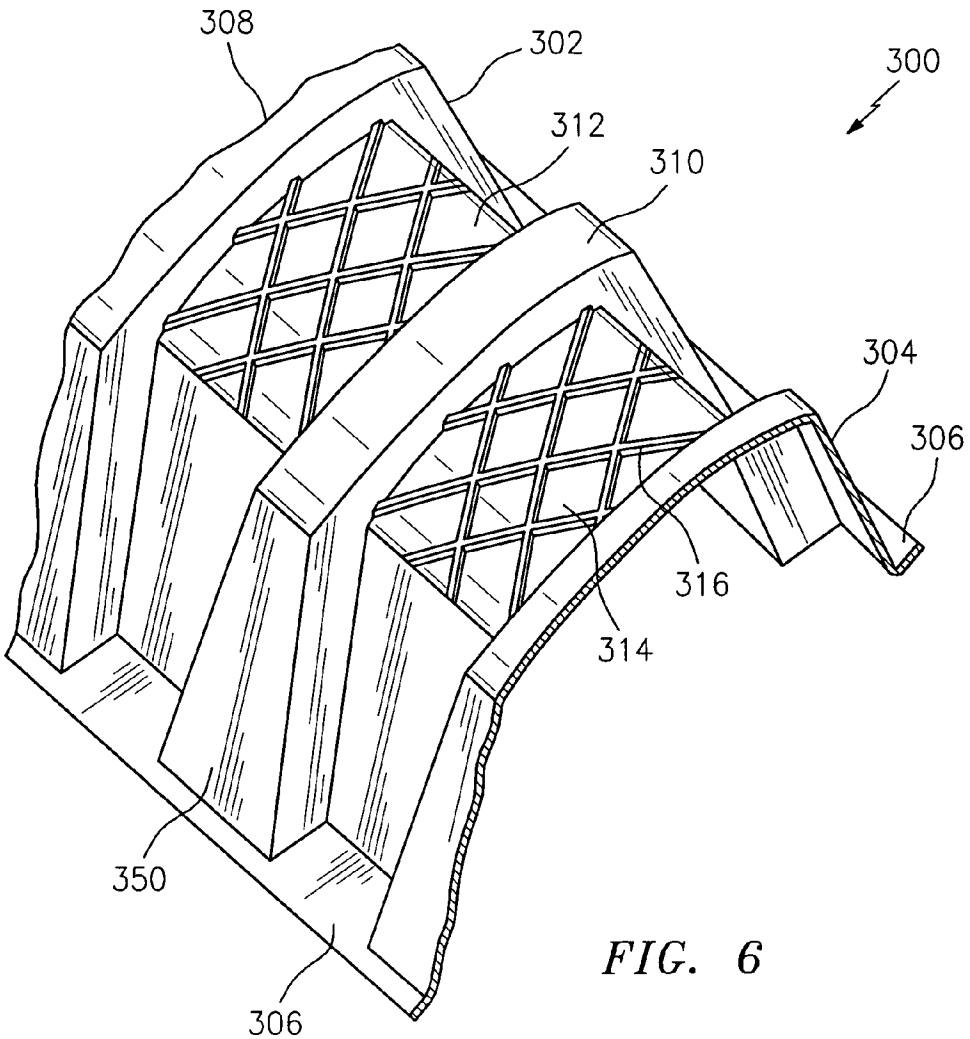
FIG. 6 is a top view of a section of a chamber having a multiplicity of diagonally crossing ribs which form a patter of diamonds, in accordance with the present invention.
Figure 7:
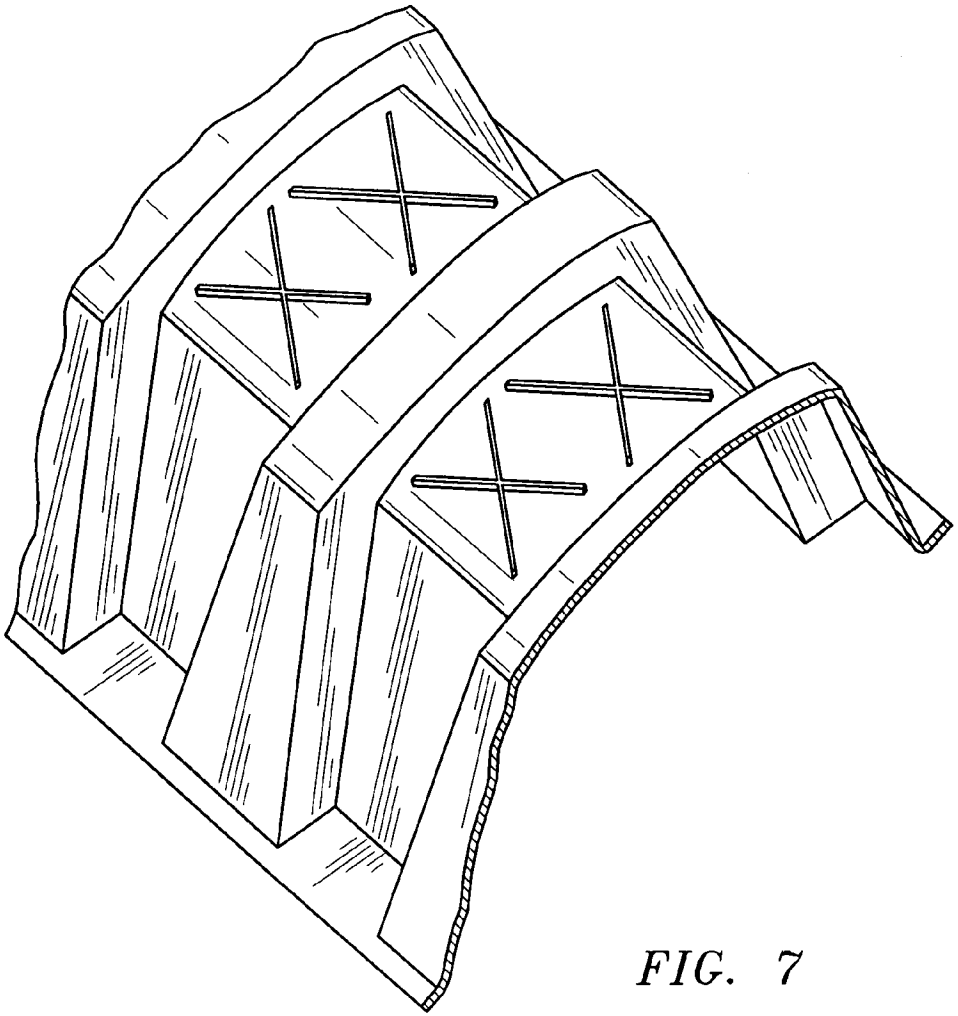
FIG. 7 is a top view of an additional embodiment of a chamber of the invention.

The present invention may be applied to newer type chambers having a curved sidewall, an example of which is shown in FIG. 1 and FIG. 2, and older type chambers having a planar sidewall (i.e., those having a generally trapezoid cross section), an example of which is shown in FIGS. 5, 6 and 7. In the present invention, the term rib refers to an integral feature that runs along and projects upwardly and/or downwardly from a surface of the chamber at least about 0.2 inches, more or less, and which has a cross sectional width of at least about 0.7 inches measured at the base of the rib (i.e. just above the elevation of the surface from which it projects). For example, one exemplary rib which may be used in connection with a 24 inches wide, 16 inches high chamber has a rectangular cross section and is 0.69 inches high and 0.07 inches wide at mid-elevation of the rib.

Preferably a rib will have a generally rectangular transverse cross section, although other cross sections may be used, for example such as are described U.S. Pat. No. 5,716,163. See also U.S. Pat. No. 7,189,027. The ribs may be solid, hollow or partially filled with material. The ribs of the present invention are thus distinguished from other features which are not significantly consequential with respect to increasing the section modulus and thereby the strength of the top of a chamber against vertical, torsional and bending loads. For instance, ribs are distinguished from so-called flow channels which facilitate the flow of plastic during injection molding or features which are decorative in nature. The ribs of the present invention are distinguished from corrugations that run transversely up one side, over and down the other side of the chamber.

With reference to FIG. 1A and FIG. 2, a curved sidewall chamber 100 having a flat portion at the top and an X shaped pattern of ribs is shown. The featured ribs are shown and discussed herein as being on the exterior portion of the chamber, but the ribs may alternatively or additionally be included on the interior portion of the chamber. FIG. 2 shows a cross section of the chamber 100 and FIG. 1A shows a top down view of a segment 102 of the leaching chamber 100 in accordance with the present invention. As shown, the leaching chamber 100 includes opposing sidewalls 104 which run the length of the chamber 100, wherein the chamber may include a base flange 106 at the foot of each of the opposing sidewalls, wherein the base flange 106 also runs the length of the chamber 100. As the opposing sidewalls 104 run upwardly in height from base flange 106, the opposing sidewalls 104 arch inwardly and upwardly toward each other to connect together at the top of the chamber 100 to form an arch shaped chamber body 108. The chamber body 108 has peaks 110 and valleys 112 which extend laterally across the chamber body 108 between the base flanges 106 of each of the opposing sidewalls 104. There may or may not be slots 150 in the opposing sidewalls 104.

There is a flat (generally horizontal) top portion 114 (the area where the opposing sidewalls 104 connect at the top of the chamber body 108) at the top of the peaks 110 and/or valleys 112 wherein the opposing sidewalls 104 come together. In the smooth and/or continuous curve of the chamber 100 this top portion 114 is areas that may be relatively flat (although top portion 114 may also be curved) so as to not increase the overall height of the chamber 100, while increasing the width and volume of the chamber 100. The inwardly and upwardly opposing sides 104 are shown as continuous curve segments which would form one continuous curve cross section, but for the top portion 114 of the top of the chamber 100. As shown, ribs 116, 118 are located on the exterior of the top portion 114 at the top of the chamber 100 and include a first rib 116 which runs diagonally along the top portion 114 between peak corrugations 110 on each side of the valley 112. A second rib 118 runs diagonally along the top portion 114 between peak corrugations 110 on each side of the valley 112 in a direction that is a mirror of the direction of the first rib 116 such that the first rib 116 and the second rib 118 intersect in a center area of the top portion 114.

This rib pair 116, 118 form an X shape pattern that advantageously provides improved resistance to the chamber bending and torque forces. Moreover, the heights of the ribs 116, 118 are preferably sufficient to provide bending strength to the top, but is insufficient to upset the desirable stacking height (nesting) of the chambers which is obtained in absence of ribs. The ribs 116, 118 compensate for the weaker structure of the flat and the abrupt contour change where the flat meets the curved side walls 104. It should be appreciated that the term "flat" is a term relative to the contour of the sidewalls and does not mean a perfectly planar portion and thus the invention is not limited to a perfectly planar portion. Additionally, it should be appreciated that the invention allows for a leaching chamber 100 having desired strength parameters, while having a top portion which has less curve and less rise than would the top of a chamber made to have a continuous curve and made to be congruent with a standard (non-flat top) chamber, while achieving the desired base width W.

It should be appreciated that while the preferred embodiments describe two or more ribs, an invention chamber may comprise only one rib 116 extending diagonally across the top portion 114. This configuration is shown in FIG. 1B. Additionally, diagonal ribs that extend beyond the top portion (such as downwardly extending ribs) are also considered to be within the scope of the invention.

Figure 3:
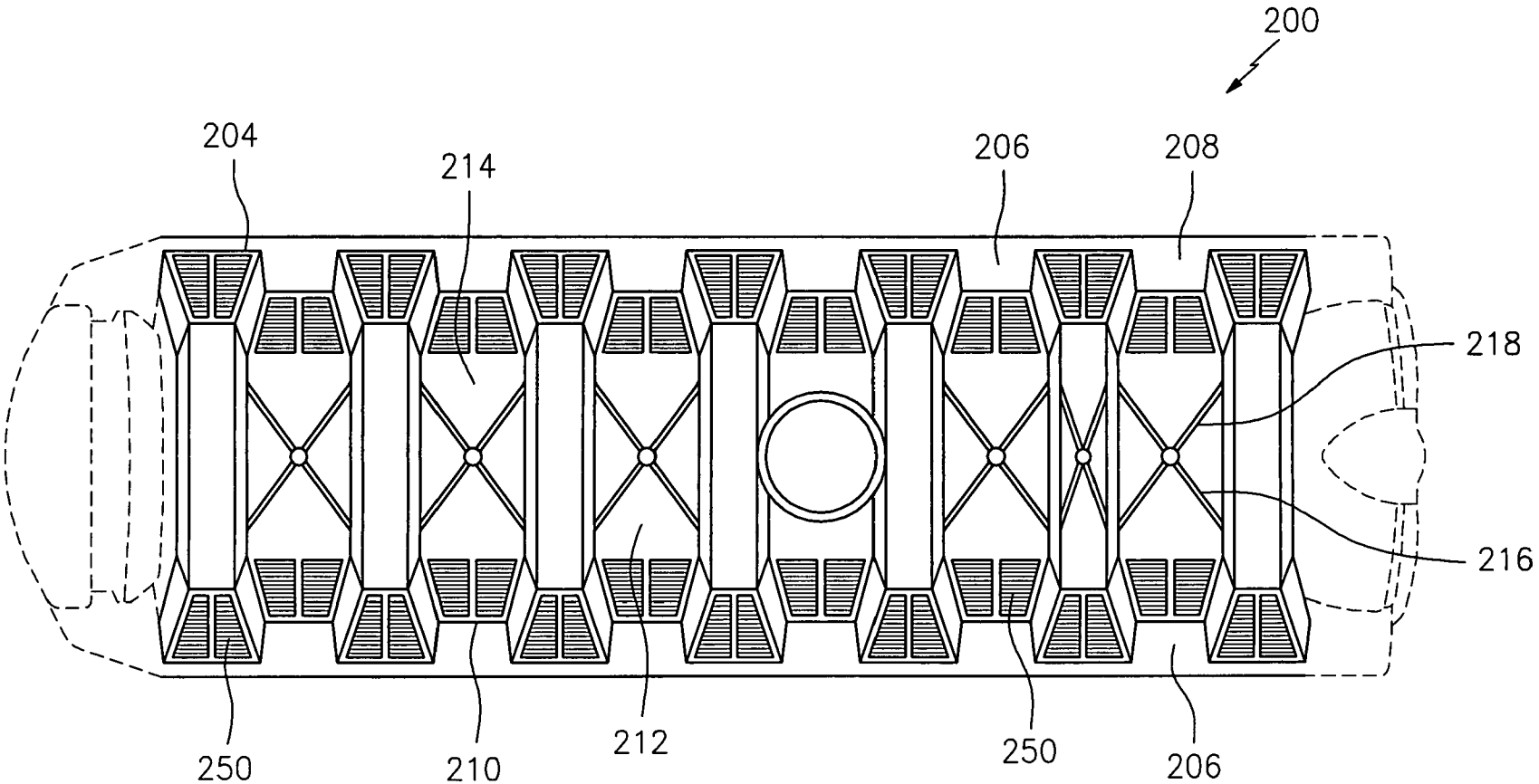
FIG. 3 is a top view of a chamber having a different cross section than that shown in FIG. 1.
Figure 4:
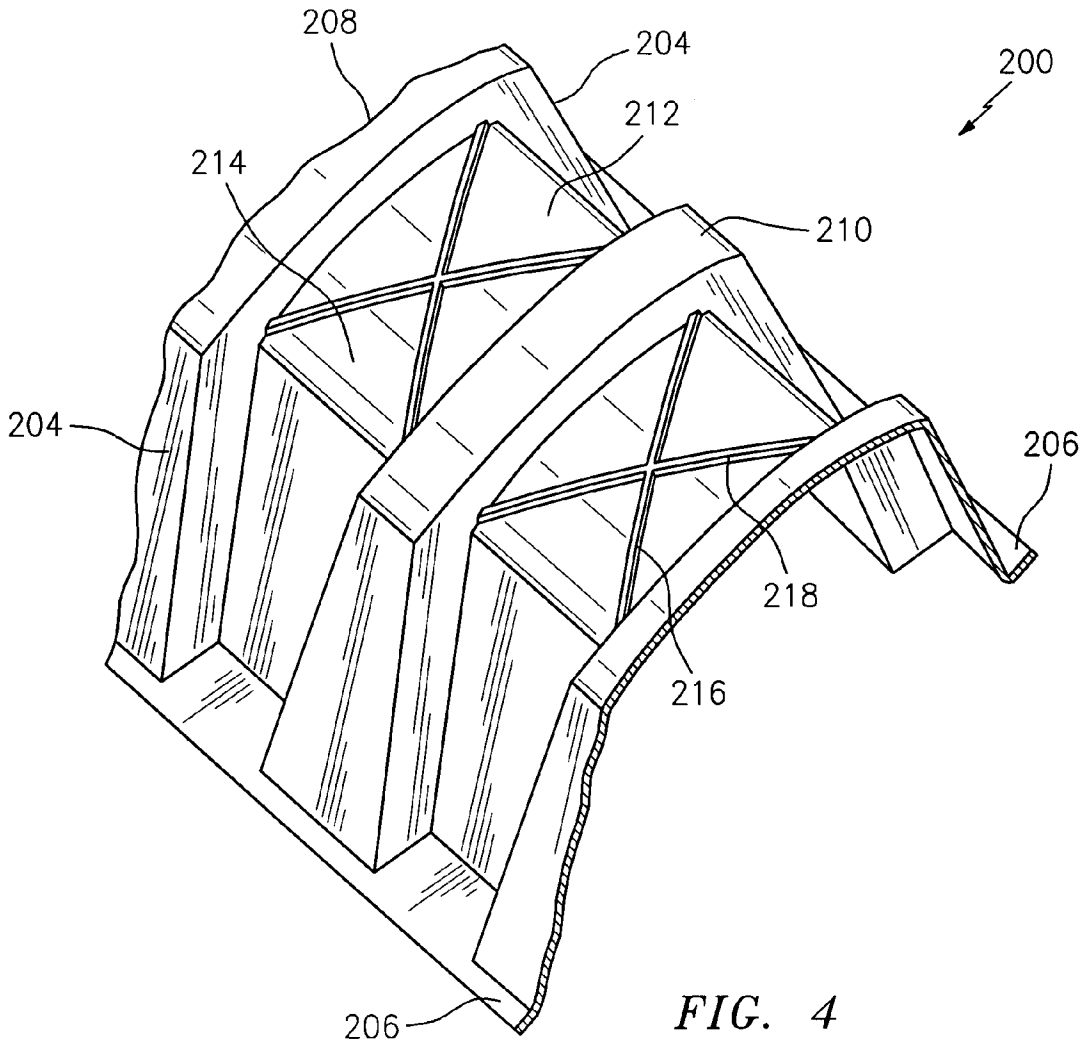
FIG. 4 is an isometric view looking down on a section of the chamber in FIG. 3.

In another embodiment, the diagonal cross ribbed pattern of the invention is applied to a chamber having an essentially trapezoid cross section and planar sidewalls, as shown in FIG. 3, FIG. 4 and FIG. 5. When the chamber sidewalls and top are sufficiently thick, the size and shape are such that ribs are not needed. However, because thick chamber sections raise the weight and cost of the chambers, providing X shaped ribs advantageously allows the chamber sections to be made thinner, thus avoiding an undesirable increase in chamber weight and cost, while increasing stiffness and maintaining or improving the torsional and bending characteristics of the chambers.

Referring again to FIGS. 3-5, a chamber 200 is shown and has opposing sidewalls 204 which run the length of the chamber 200, wherein the chamber 200 may include a base flange 206 at the foot of each of the opposing sidewalls 204, wherein the base flange 206 also runs the length of the chamber 200. As the opposing sidewalls 204 run upwardly in height from base flange 206, the opposing sidewalls 204 arch inwardly and upwardly toward each other to connect together at the top of the chamber 200 to form the chamber body 208. The chamber body 208 has peaks 210 and valleys 212 which extend laterally across the chamber body 208 between the base flanges 206 of each of the opposing sidewalls 204. There may or may not be slots 250 in the opposing sidewalls 204.

There is a curved top portion 214 (the area where the opposing sidewalls 204 connect at the top of the chamber body 208) at the top of the valleys 212 (and in this chamber 200 at the tops of the peaks 210) wherein the opposing sidewalls 204 come together as shown in the figures. The intersect of the opposing sidewalls 204 and top portion 214 is shown at line 215. As shown, ribs 216, 218 are located on the exterior of the top portion 214 at the top of the chamber 200 and include the first rib 216 which runs diagonally along the top portion 214 between peak corrugations 210 on each side of the valley 212 A second rib 218 runs diagonally along the top portion 214 in a direction which is a mirror image to the direction of the first rib 216, such that the first rib 216 and the second rib 218 intersect in a center area of the top portion 214. As which the chamber 100, diagonally intersecting ribs 216, 218 form an X pattern which provides improved resistance to the chamber bending and torque forces.

In another aspect of the invention, there is an array of ribs forming a pattern which defines one or more diamond shaped regions. FIG. 6 shows a segment 302 of a chamber 300 having ribs which define a multiplicity of such diamond shaped regions. Referring to FIG. 6, a top down view of a segment 302 of a chamber having a cross section and other features like chamber 200 of FIG. 3 is provided, in accordance with the invention. As shown, the chamber 300 includes opposing sidewalls 304 which run the length of the chamber 300, wherein the chamber 300 may include a base flange 306 at the foot of each of the opposing sidewalls 304, wherein the base flange 306 also runs the length of the chamber 300. Similarly to the previously discussed chambers 100, 200, as the opposing sidewalls 304 run upwardly in height from base flange 306, the opposing sidewalls 304 connect together near the top of the chamber 300 to form the chamber body 308. The chamber body 308 has peaks 310 and valleys 312 which extend laterally across the chamber body 308 between the base flanges 306 of each of the opposing sidewalls 304. There may or may not be slots 350 in the opposing sidewalls 304 which may or may not be curved.

There is a top portion 314 at the top of the valleys 312 which connect the opposing sidewalls 304 together. As shown, a plurality of ribs 316 are located on the exterior of the top portion 314 at the top of the chamber 300, wherein a first portion of the plurality of ribs 316 extend diagonally in one direction across the top portion 314 between the peak corrugations 310 on each side of the valley 312 and a second portion of the plurality of ribs 316 extend diagonally in a direction that is a mirror of the direction of to the first portion of ribs 316 across the top portion 314 between the peak corrugations 310 on each side of the valley 312. Accordingly, the first portion of the plurality of ribs 316 intersect the second portion of the plurality of ribs 316 to form a multiplicity of diamond and/or triangular shaped regions on the top portion 314 which substantially enhance strength.

FIG. 7 shows still another embodiment wherein there are two adjacent sets of X shape pattern ribs. Other variations of diagonal ribs may be used within the invention. In the generality of the invention, the top of the chamber has at least one rib which runs in a vertical plane which plane runs at an angle greater than 10 degrees and preferably 45 degrees, to the longitudinal center plane of the chamber.

It should be appreciate that while the invention has been described herein as applied to leaching chambers, it is contemplated that the invention may be applied to other kinds of chambers than leaching chambers, such as for example storm chambers. Moreover, while the invention has been described herein as being applied to leaching chambers having an arch shape and/or trapezoidal shape cross section, the invention may be applied to chambers having other shape cross sections than those which have been described herein. Additionally, it is contemplated that a single diagonally oriented rib may be used in place of two diagonally oriented ribs (i.e. that form an X shaped pattern). Moreover, it is considered to be within the scope of the invention that the ribs may be integrally formed into the chamber or connected thereto. It should also be appreciated that the top portion may be considered to be formed by the sidewalls at the top of the chamber (as for example in FIG. 1A) or the top portion may be considered to connect the sidewalls at the top of the chamber (as for example in FIG. 3). Also, ribs may be disposed on the peak corrugations as well.

Chambers of the present invention are preferably made of poly-ethylene, poly-propylene or other olefin thermoplastic and are preferably made by injection molding. Chambers may be made by other processes and of other materials as well. For instance, a chamber may be made by thermal forming or rotational molding or it may be made by an assembly of welded parts.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A leaching chamber having opposing inwardly and upwardly running sidewalls extending toward a top portion to form a plurality of peak and valley corrugations extending over the top portion, the leaching chamber comprising:

a plurality of diagonally opposed ribs, wherein the plurality of diagonally opposed ribs are located in the valleys of the top portion and include a first rib extending in one direction diagonally across a part of the top portion between the peak corrugations on each side of the valley and a second rib extending diagonally across a part of the top portion in a direction that is a mirror of the direction of the first rib between the peak corrugations on each side of the valley to form an X shaped pattern across said part of the top portion in the valley, wherein said part of the top portion in the valley is free of any ribs extending along a lengthwise direction of the leaching chamber.

2. The leaching chamber of claim 1, wherein the first rib and second rib intersect in a center area of the top portion.

3. The leaching chamber of claim 1, wherein the inwardly and upwardly curving sidewalls connect at the top of the chamber to form the top portion and wherein the top portion is curved.

4. The leaching chamber of claim 1, wherein the inwardly and upwardly running sidewalls are planar and connect to a top portion at the top of the chamber.

5. The leaching chamber of claim 1, wherein the plurality of ribs have a height of about 0.2 inches and a width of about 0.7 inches.

6. The chamber of claim 1, wherein the ribs extend at least one of upwardly and downwardly from the surface of the top portion.

7. An arch shaped cross section chamber, for use in receiving and dispersing wastewater or storm-water within soil, having corrugations comprised of a multiplicity of alternating peaks and valleys which run transversely to the length of the chamber, comprising:

opposing sidewalls running inwardly and upwardly towards a top of the chamber from opposing side base flanges, wherein the top of the chamber connects the upper portions of the opposing sidewalls; and a plurality of ribs running across a portion of the tops of the valleys, each rib lying in a vertical plane which runs diagonally relative to the vertical lengthwise center plane of the chamber to form an X shaped pattern of ribs across said portion of the tops of the valleys such that a first X shaped pattern of ribs is located on one side of the valley relative to a longitudinal center plane extending along a lengthwise direction of the leaching chamber, and a second X shaped pattern of ribs is located on the opposing side of the valley relative to the longitudinal center plane extending along a lengthwise direction of the leaching chamber, wherein the surface of the valley located between the first X shaped pattern of ribs and the second X shaped pattern of ribs is free of an upwardly projecting structure running between the peak on one side of the valley to the peak on the opposing side of the valley.

8. The chamber of claim 7, wherein the plurality of ribs include a first rib extending in one direction diagonally across the top of the valley and a second rib extending diagonally across the top of the valley in a direction that is a mirror of the direction of the first rib to form at least one X shaped pattern.

9. The chamber of claim 8, wherein the first and second ribs intersect in a center area of said portion of the tops of the valleys.

10. The chamber of claim 7, wherein the plurality of ribs extend across at least a portion of the top of the valley between the peak corrugations to form a plurality of X shaped patterns.

11. The chamber of claim 7, wherein the inwardly and upwardly running sidewalls connect at the top of the chamber to form the top portion and wherein the sidewalls and top portion is curved.

12. The chamber of claim 7, wherein the inwardly and upwardly running sidewalls are planar.

13. The chamber of claim 7, wherein the plurality of ribs have a height of about 0.2 inches and a width of about 0.7 inches.

14. The chamber of claim 7, wherein the ribs extend at least one of upwardly and downwardly from the surface of the top of the valleys.

15. A chamber comprised of peak and valley corrugations and having a base, a top portion, and opposing sidewalls running inwardly and upwardly from the base to the top portion, comprising:

a plurality of diagonally opposed ribs located in at least one of the peak and valley corrugations at the top portion of the chamber, the plurality of ribs extending diagonally across at least a portion of the top portion to form an X shaped pattern across said portion of the top portion, wherein said portion of the top portion is free of any ribs extending along a lengthwise direction of the chamber.

16. The chamber of claim 15, wherein the plurality of ribs are located in the valley of the top portion and include a first rib extending in one direction diagonally across the top portion between the peak corrugations on each side of the valley and a second rib extending diagonally across the top portion in a direction that is a mirror of the direction of the first rib between the peak corrugations on each side of the valley to form at least one X shaped pattern.

17. An arch shaped cross section chamber, for use in receiving and dispersing wastewater or storm-water within soil, having corrugations comprised of a multiplicity of alternating peaks and valleys which run transversly to the length of the chamber, comprising:

opposing sidewalls running inwardly and upwardly towards a top of the chamber from opposing side base flanges, wherein the top of the chamber connects the upper portions of the opposing sidewalls; and a plurality of ribs running across a portion of the tops of the valleys, each rib lying in a vertical plane which runs diagonally relative to the vertical lengthwise center plane of the chamber to form an X shaped pattern of ribs across said portion of the tops of the valleys such that a first X shaped pattern of ribs is located on one side of the valley relative to a longitudinal center plane extending along a lengthwise direction of the leaching chamber, and a second X shaped pattern of ribs is located on the opposing side of the valley relative to a longitudinal center plane extending along a lengthwise direction of the leaching chamber, wherein the surface of the valley located between the first X shaped pattern of ribs and the second X shaped pattern of ribs is free of an X shaped pattern of ribs or a circular spot.

* * * * *